US010773180B2

(12) United States Patent
Fu et al.

(10) Patent No.: US 10,773,180 B2
(45) Date of Patent: Sep. 15, 2020

(54) ARTICLE AND PACKAGING FOR GENERATING BUBBLES

(71) Applicant: OgoSport LLC, Brooklyn, NY (US)

(72) Inventors: Jenie Ping Fu, Putnam Valley, NY (US); Kevin Williams, Sprakers, NY (US); Matthew Romano, Brooklyn, NY (US); Benjamin Dominic Nimes, Brooklyn, NY (US)

(73) Assignee: OGOSPORT LLC, Brooklyn, NY (US)

( * ) Notice: Subject to any disclaimer, the term of this patent is extended or adjusted under 35 U.S.C. 154(b) by 0 days.

(21) Appl. No.: 16/459,073

(22) Filed: Jul. 1, 2019

(65) Prior Publication Data

US 2019/0321743 A1 Oct. 24, 2019

Related U.S. Application Data

(63) Continuation of application No. 16/164,520, filed on Oct. 18, 2018, now Pat. No. 10,335,704, which is a (Continued)

(51) Int. Cl.
*A63H 33/28* (2006.01)
*B65D 73/00* (2006.01)

(Continued)

(52) U.S. Cl.
CPC ..... *A63H 33/28* (2013.01); *A41B 11/00* (2013.01); *A41D 19/0024* (2013.01);

(Continued)

(58) Field of Classification Search
CPC .... A63H 33/28; A41B 11/00; A41D 19/0024; B65D 73/0064; B65D 75/30;

(Continued)

(56) References Cited

U.S. PATENT DOCUMENTS 689,840 A * 12/1901 Jensen ..... A63B 31/04 441/57
742,440 A * 10/1903 Johnson ..... A63B 31/04 441/57

(Continued)

FOREIGN PATENT DOCUMENTS

CN 203709365 U 7/2014
FR 2805473 A1 8/2001

(Continued)

OTHER PUBLICATIONS

PCT Application No. PCT/US2017/041532—International Search Report and Written Opinion dated Sep. 22, 2017.

(Continued)

*Primary Examiner* — Alexander R Niconovich
(74) *Attorney, Agent, or Firm* — Kane Kessler, P.C.; Barry E. Negrin

(57) ABSTRACT

An article for soap bubble generation is provided as a liquid-resistant wearable article. A web is provided integrally with the article having at least one hole adapted to form soap bubbles when the web is dipped in bubble solution and air is moved through the at least one hole. Preferably, the article has films of liquid-resistant material sealed at a common edge and a pocket therebetween. The pocket may be shaped to receive a body part such as a hand (e.g., the article is glove/mitten-shaped). The article substantially prevents a body part inside the pocket from touching the bubble solution when the web is dipped in the bubble solution while the article is being worn. Different sizes of holes may be provided in the web to generate different sizes of bubbles.

20 Claims, 7 Drawing Sheets

Related U.S. Application Data continuation of application No. 15/644,347, filed on Jul. 7, 2017, now Pat. No. 10,105,618.

(60) Provisional application No. 62/376,077, filed on Aug. 17, 2016.

(51) Int. Cl.

| | |
|---|---|
| ***B65D 81/36*** | (2006.01) |
| ***B65D 75/58*** | (2006.01) |
| ***B65D 75/30*** | (2006.01) |
| ***A41D 19/00*** | (2006.01) |
| ***A41B 11/00*** | (2006.01) |
| ***A63H 37/00*** | (2006.01) |
| ***A63J 5/02*** | (2006.01) |

(52) U.S. Cl.
CPC ..... *A63H 37/00* (2013.01); *A63J 5/02* (2013.01); *B65D 73/0064* (2013.01); *B65D 75/30* (2013.01); *B65D 75/5805* (2013.01); *B65D 81/363* (2013.01)

(58) Field of Classification Search
CPC .. B65D 75/5805; B65D 81/363; A63B 31/04; A63B 31/08; A63B 31/10
USPC ..... 446/15, 16, 26; 2/159, 160; 441/56, 57
See application file for complete search history.

(56) References Cited

U.S. PATENT DOCUMENTS 819,852 A * 5/1906 Christopher ..... A63B 31/04 441/57
1,014,939 A * 1/1912 Boman ..... A63B 31/04 441/57
1,021,323 A * 3/1912 McMurtry ..... A42B 1/24 2/209.13
1,179,581 A * 4/1916 Virneburg ..... A63B 31/04 441/57
1,275,005 A * 8/1918 Eckman ..... A63B 31/04 441/57
1,588,635 A * 6/1926 Webb ..... A63B 31/04 441/57
1,669,010 A * 5/1928 Fritz ..... A63B 31/04 441/57
1,679,679 A * 8/1928 Strange ..... A63B 31/04 441/57
1,746,268 A * 2/1930 Lepetich ..... A63B 31/04 441/57
1,888,867 A * 11/1932 Schmitt ..... A63B 31/04 441/57
2,004,684 A * 6/1935 Bell ..... A63B 31/04 441/57
2,028,461 A * 1/1936 Lindsey ..... A63B 31/04 441/57
2,324,375 A * 7/1943 Eslick ..... A63B 31/04 441/57
2,836,926 A * 6/1958 Tseng ..... A63H 33/28 446/15
3,008,263 A * 11/1961 Ellman ..... A63H 33/28 446/15
3,023,432 A * 3/1962 Loomis ..... A63B 31/04 441/57
3,174,167 A * 3/1965 Pauley ..... A63B 31/04 441/57
3,231,910 A * 2/1966 Tegland ..... A63B 31/04 441/57
3,286,287 A * 11/1966 Knox ..... A63B 31/08 441/57
3,295,248 A * 1/1967 Knerr ..... A63H 33/28 446/15
3,745,693 A * 7/1973 La Fata ..... A63H 33/28 446/15
3,775,899 A * 12/1973 Wolf ..... A63H 33/28 446/17
3,874,014 A * 4/1975 Davey ..... A63B 31/04 441/57
3,938,207 A * 2/1976 Drescher ..... A63B 31/04 441/57
3,950,887 A * 4/1976 Kort ..... A63H 33/28 446/15
4,027,347 A * 6/1977 Sato ..... A63B 31/04 441/57
4,058,863 A * 11/1977 Ferdico ..... A63B 31/04 441/57
4,121,312 A * 10/1978 Penney ..... A63B 31/04 441/57
4,180,938 A * 1/1980 La Fata ..... A63H 33/28 446/15
4,184,284 A * 1/1980 Rogahn ..... A63H 33/28 446/15
4,195,365 A * 4/1980 Eyman ..... A63B 31/04 2/161.1
4,345,335 A * 8/1982 Shih-Li ..... A63B 31/04 2/161.1
4,618,328 A * 10/1986 Chi ..... A63B 31/04 441/57
4,669,991 A * 6/1987 Southworth ..... A63B 31/04 441/57
4,677,697 A * 7/1987 Hayes ..... A41D 19/0068 2/159
D292,641 S 11/1987 Jernander
4,746,313 A * 5/1988 Bray ..... A63B 31/04 441/57
4,832,643 A * 5/1989 Schoofs ..... A63B 31/04 441/56
4,964,824 A * 10/1990 Spencer ..... A63B 31/04 441/57
5,041,042 A * 8/1991 Stein ..... A63H 33/18 446/15
5,049,103 A * 9/1991 Pearl ..... A63H 33/38 446/19
5,080,623 A * 1/1992 Stein ..... A63H 33/28 446/15
5,102,381 A * 4/1992 Danielak ..... A63B 5/20 446/15
5,312,278 A * 5/1994 Jen ..... A63B 31/04 441/57
5,515,547 A * 5/1996 Middleton ..... A41D 19/00 2/158
5,603,651 A * 2/1997 Shure ..... A63H 33/28 446/16
5,641,316 A * 6/1997 Bakalis ..... A63B 31/04 441/57
5,695,379 A * 12/1997 Ho ..... A63H 33/28 446/15
5,704,821 A * 1/1998 Mann ..... A63H 33/28 446/16
5,806,099 A 9/1998 Grinberg
5,890,942 A * 4/1999 Souza-Ferreira ..... A63H 33/28 446/18
5,966,741 A * 10/1999 Klecina ..... A41D 19/0068 2/159
6,019,650 A * 2/2000 Rives ..... A63B 31/10 441/56
6,058,510 A * 5/2000 Breitenbach ..... A41D 19/01594 172/371
6,088,835 A * 7/2000 Perkins ..... A41D 19/01558 2/161.1
6,093,075 A * 7/2000 Lin ..... A63H 33/28 446/16
6,109,214 A * 8/2000 Rampersad ..... A46B 5/04 119/600
6,142,845 A * 11/2000 Feldman ..... A63H 3/20 40/419
6,231,414 B1 * 5/2001 Ho ..... A63H 33/28 446/15
6,351,867 B1 * 3/2002 Forster ..... A47K 7/02 15/121

(56) References Cited

U.S. PATENT DOCUMENTS 6,497,340 B2 * 12/2002 Grinberg ..... A41D 19/0072 2/158
6,520,822 B2 * 2/2003 Kennedy ..... A63H 33/28 446/15
6,745,403 B2 * 6/2004 Sajovic ..... A41D 19/01547 2/161.1
6,772,441 B2 * 8/2004 Lucas, Jr. ..... A41D 19/01582 2/161.1
6,829,802 B2 * 12/2004 McKenzie ..... A47L 13/18 15/210.1
D502,573 S 3/2005 Jones
7,424,400 B2 9/2008 McCormack et al.
7,578,714 B2 * 8/2009 MacKay ..... A63B 31/04 2/158
7,582,045 B1 * 9/2009 Lombardi ..... A63B 21/00069 434/255
7,584,519 B2 * 9/2009 Ouellette ..... A47L 13/19 15/104.93
7,892,066 B2 * 2/2011 Kelley ..... A63H 33/28 446/15
7,908,673 B2 * 3/2011 Kerr-Maddox .... A41D 19/0034 2/163
8,069,526 B2 * 12/2011 Malaska ..... A47L 13/18 15/118
8,790,224 B1 * 7/2014 Davis ..... A63B 21/0084 441/50
8,813,302 B1 * 8/2014 Capito ..... A47L 13/18 15/227
8,961,251 B1 * 2/2015 Lewis ..... A63B 21/4043 441/57
9,162,156 B2 * 10/2015 Cripe ..... A63H 33/28
10,105,618 B2 10/2018 Fu et al.
10,137,330 B1 * 11/2018 Xu ..... A63B 31/04
10,335,704 B2 7/2019 Fu et al.
2005/0186865 A1 * 8/2005 Harwell ..... A63B 31/02 441/57
2008/0015092 A1 * 1/2008 Montoya ..... A63H 33/28 482/82
2009/0061727 A1 * 3/2009 Styles ..... A63H 33/28 446/15
2012/0017352 A1 * 1/2012 Waddell ..... A63B 47/001 2/161.1
2014/0024282 A1 * 1/2014 Lin ..... A63H 33/28 446/15
2015/0056884 A1 * 2/2015 Fogarty ..... A63H 33/28 446/15
2016/0158663 A1 * 6/2016 Fogarty ..... A63H 33/18 446/15
2018/0050278 A1 2/2018 Fu

FOREIGN PATENT DOCUMENTS

GB 254768 A 7/1926
JP 2011-206612 10/2011

OTHER PUBLICATIONS

European Patent Appln. No. 17841801.8—extended European Search report dated Nov. 20, 2018.
European Patent Application No. 19192943.9—Extended European Search Report dated Nov. 27, 2019.
Chinese Patent Application No. 201780006235.3—First Office Action dated Dec. 4, 2019.
Canadian Patent Applin. No. 3,051,356—Office Action dated Sep. 17, 2019.
European Patent Appln. No. 17841801.8—Office Action dated Oct. 15, 2019.

* cited by examiner

ARTICLE AND PACKAGING FOR GENERATING BUBBLES

RELATED APPLICATIONS

This is a continuation application of U.S. patent application Ser. No. 16/164,520, filed Oct. 18, 2018 and entitled "ARTICLE AND PACKAGING FOR GENERATING BUBBLES", issuing as U.S. Pat. No. 10,335,704 on Jul. 2, 2019, which is a continuation of U.S. patent application Ser. No. 15/644,347, filed Jul. 7, 2017 and entitled "WEARABLE ARTICLE AND PACKAGING FOR GENERATING BUBBLES", which issued as U.S. Pat. No. 10,105,618 on Oct. 23, 2018, which claims priority to U.S. Provisional Patent Application No. 62/376,077, filed Aug. 17, 2016, and entitled "WEARABLE ARTICLE AND PACKAGING FOR GENERATING BUBBLES", the entirety of all of which are incorporated by reference herein.

BACKGROUND OF THE INVENTION

Field of the Invention

The invention is directed to devices for manually generating bubbles. The invention is also directed to environmentally friendly and cost-efficient packaging that can also serve as a device for manually generating bubbles.

Description of Related Art

Blowing bubbles has been a fun outdoor activity for children (and adults) for decades. Conventionally, one takes a wand that has a hole or two at one end and dips it into a soapy solution, thereby forming a membrane or film across the hole. One then blows substantially orthogonally to the plane of the soapy film to create one or more soap bubbles. Blowing at a slower rate will typically create fewer but larger bubbles, while blowing at a faster rate will typically create more but smaller bubbles.

Fun as it may be, there are some drawbacks to this activity. For starters, one typically gets the soapy liquid on oneself and ends up a sticky mess, especially on one's hands. Also, most bubble wands have a single or very few holes in the distal (blowing) end, resulting in few bubbles being produced at a time. Additionally, for small children or the otherwise inexperienced bubble blower, often it is difficult to find the right rate of blowing to achieve good bubbles: blow too softly and nothing happens; blow too hard and the soapy film collapses and nothing happens. It can be very frustrating.

Accordingly, there is a long-felt need for a new device for generating bubbles that does not require the finesse of blowing and also keeps one relatively clean and mess-free. There is another long-felt need for a device to generate bubbles manually easily and in great quantities.

SUMMARY OF THE INVENTION

The invention solves the above and other issues in the bubble generating arts and is a wearable article such as a glove for generating bubbles. Two films of material are attached together, e.g., two thin films of plastic are welded together to form an article that, in one embodiment, is sealed around most sides but open at a proximal end to form a pocket to allow entry of a body part such as a hand. Preferably, the article is shaped like a glove or a mitten, i.e., substantially hand-shaped (either with or without individual finger tubes). At the distal end, the two films are sealed together to form a web that is more rigid or stiff than each individual film. The distal web is provided with one or more holes, preferably a plurality of holes in a plurality of sizes. The distal web is dipped in bubble solution, and the user can either wave his/her arm to generate bubbles (caused by the web passing through the air) or blow on the distal web as before.

The invention also includes a new packaging system for a bubble generating device. The packaging itself is used as the bubble generator. The packaging includes two films of material attached together, e.g., two thin films of plastic are welded (or similar process) together to form an article that is sealed around most sides but provided with a scored or similar structured tearoff edge at a proximal end and thus forming an openable pocket. Items can be placed inside that pocket so that the article serves as the packaging for those items inside. For example, soapy material can be placed inside the article in any of the following exemplary and non-limiting forms: in a packet in powder form; in a packet in liquid/gel form; as a bar of soap (e.g., for the bath); or as loose powder inside the article. Soapy material is used as an example because it can be added to water to form the requisite soapy material suitable for generating bubbles. Other items such as toys, collectibles, etc. could be placed inside the article in addition or in the alternative.

When the tearoff edge is torn off or otherwise removed, the item inside can be removed from the packaging/glove, and a body part such as a hand can be inserted therein. As above, at the distal end, the two films are sealed together to form a more rigid web. The distal web is provided with one or more holes, preferably a plurality of holes in a plurality of sizes. The distal web is dipped in bubble solution, and the user can either wave his/her arm to generate bubbles (caused by the web passing through the air) or blow on the distal web as before.

Other-shaped articles to be worn and generate bubbles are also contemplated.

In one embodiment of the invention, the invention is a wearable article for soap bubble generation. The article has at least two films of liquid-resistant material, sealed on at least one common edge, that form a pocket between the films, the pocket being shaped to receive a body part. A distal web is provided integrally with the article, the distal web having at least one hole adapted to form soap bubbles when the web is dipped in bubble solution and air is moved through the at least one hole. The films of the article substantially prevent the body part inside the pocket from touching the bubble solution when the web is dipped in the bubble solution while the article is being worn. Preferably, the web is formed by the fusion of the at least two films at respective distal ends of the at least two films. Preferably, the article is a glove or mitten and the pocket is shaped to receive a hand. As an alternative, the article is sock-like and the pocket is shaped to receive a foot.

Optionally, a proximal end of the article further includes a removable edge portion sealing the pocket closed and being manually removable. The removable edge portion is preferably attached to the article via a manually tearable region, which is scored or perforated or similarly weakened to facilitate manual removal. Optionally, a secondary article is provided inside the pocket, wherein the article functions as packaging for the secondary article. The secondary article can be at least one of a container of bubble solution or a packet of soap powder to be made into bubble solution, or a toy or similar collectible.

In any event, preferably, the at least one hole in the distal web includes a plurality of holes. More preferably, the holes in the distal web are formed in a plurality of different sizes.

Preferably, the at least two films are comprised of plastic and are heat welded together at the at least one common edge. Optionally, each of the films comprises at least one layer of polyethylene terephthalate and at least one layer of copolymer polypropylene. As an alternative, each of the films comprises at least one layer of polyethylene.

In another embodiment, the invention is a wearable article for soap bubble generation. The liquid-resistant wearable article has a body-receiving portion shaped to receive a body part and a web provided integrally with the article. The web has at least one hole adapted to form soap bubbles when the web is dipped in bubble solution and air is moved through the at least one hole. Optionally, the wearable article is substantially tubular and the body-receiving portion is shaped to be placeable on a limb. Preferably, the at least one hole in the distal web further comprises a plurality of holes, preferably formed in a plurality of different sizes. Optionally, the article comprises at least one layer of polyethylene terephthalate and at least one layer of copolymer polypropylene. As an alternative, the article comprises at least one layer of polyethylene.

DETAILED DESCRIPTION OF THE INVENTION AND DRAWINGS

Figure 1:
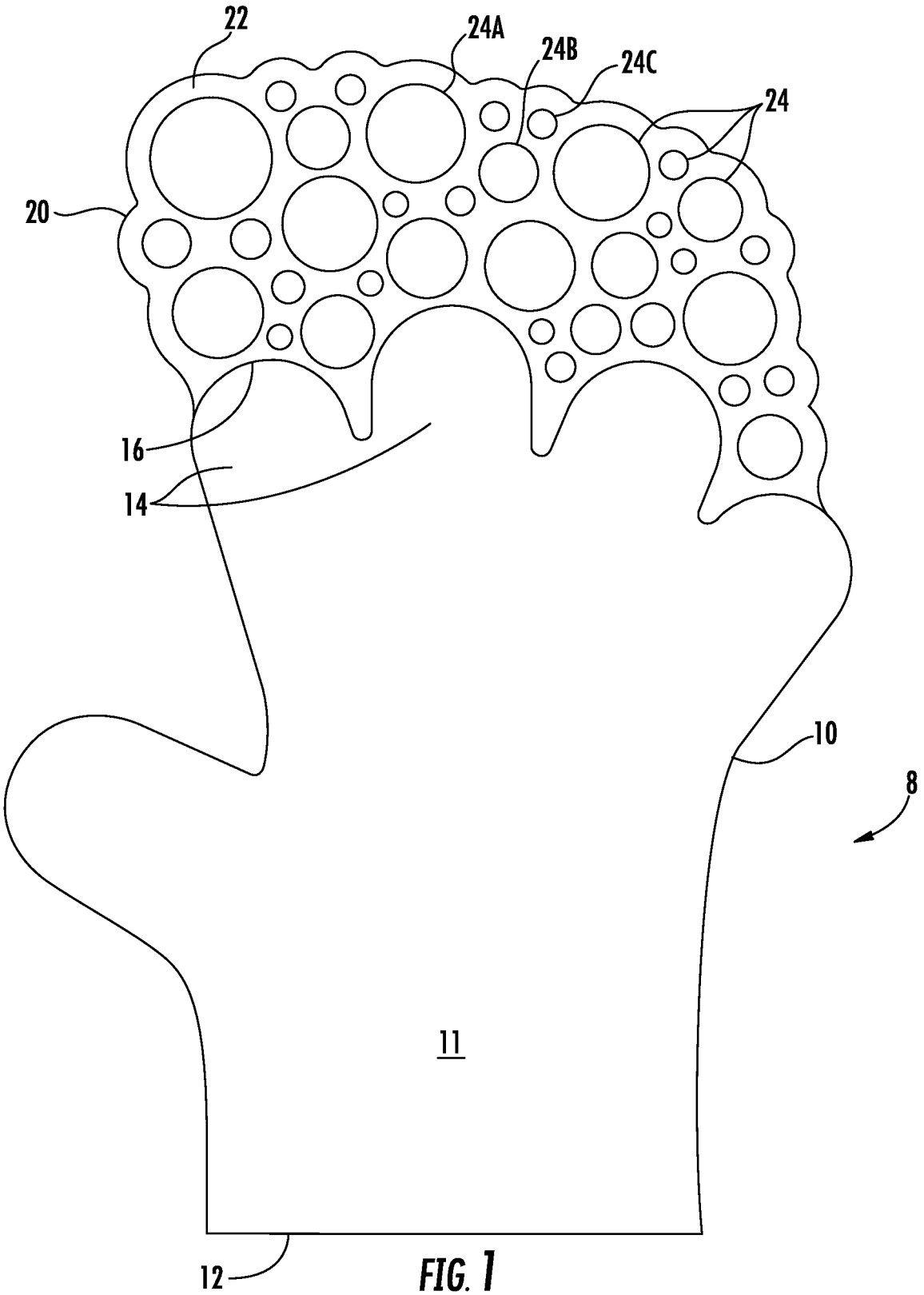
FIG. 1 is a front elevational view of one embodiment of an article for generating bubbles in accordance with the invention.
Figure 2:
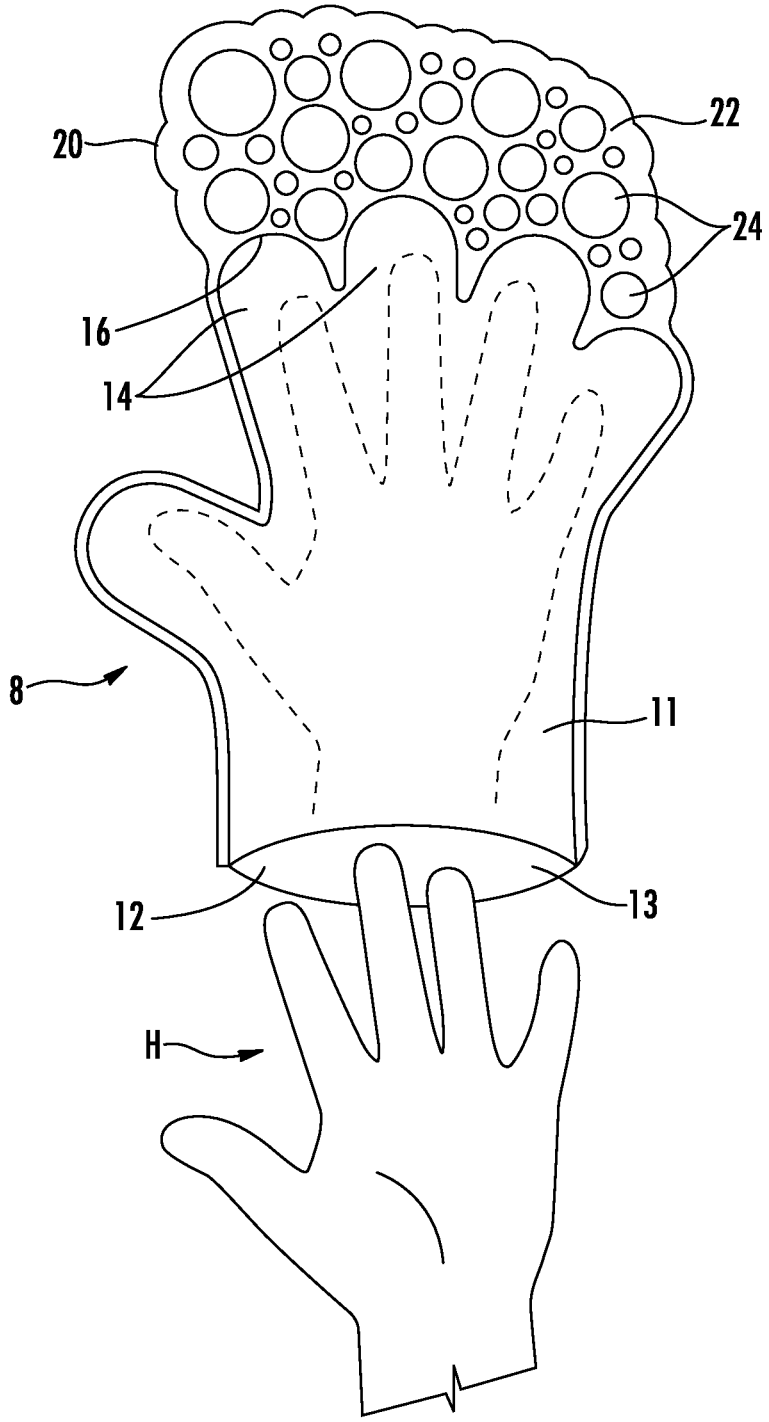
FIG. 2 is a perspective view of the article for generating bubbles of FIG. 1 shown with a user's hand.

Description will now be given with reference to the attached FIGS. 1-10. It should be understood that these figures are exemplary in nature and in no way serve to limit the scope of the invention, which is defined by the claims appearing hereinbelow.

An embodiment of the invention is shown in FIGS. 1-7 as bubble glove 8 in several versions 8, 108, 208. In each version, the bubble glove has a proximal glove portion 10 and a distal web portion 20. Glove portion 10 is formed from two films 11 and 13 of a material, typically a plastic, secured together substantially in the shape of a hand/glove. Films 11 and 13 are not secured all the way around so as to leave an opening 12 and form a pocket so that a user can insert his/her hand H (FIG. 2) inside. In one version, glove portion 10 has finger tubes 14 at its distal end to receive the individual fingers of hand H. In another version, glove portion 10 does not have individual finger tubes and is more mitten-like than glove-like.

Formed secured to the distal end of glove portion 10 is web portion 20, which is the portion of the device that actually generates bubbles. Web portion 20 includes web 22 through which are formed a plurality of holes 24. In the embodiment shown, holes 24 come in three different sizes: large holes 24A, medium holes 24B, and small holes 24C. More or fewer holes and sizes of holes are also contemplated as being within the scope of the invention. Web 22 is preferably formed from the two films 11 and 13 being completely fused together so that web 22 is thicker and more rigid/stiff than either film 11 or 13 is separately.

Figure 4:
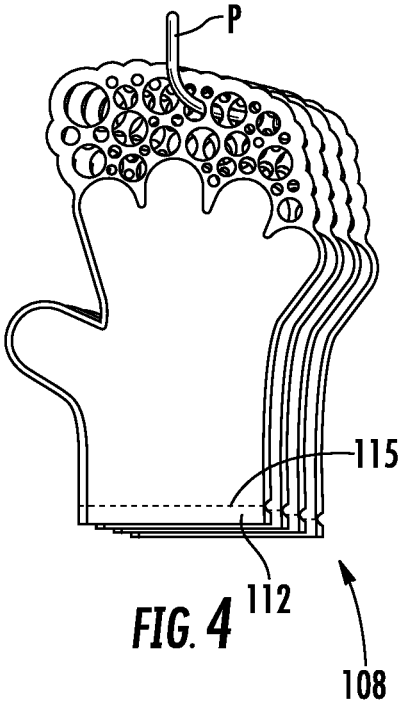
FIG. 4 is a front elevation view of an embodiment of an article for generating bubbles in accordance with the invention being displayed in a commercial setting.
Figure 5:
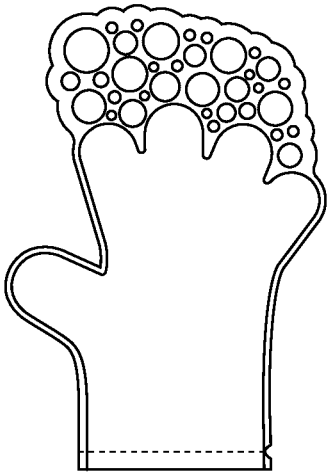
FIG. 5 is a front elevation view of the embodiment of an article for generating bubbles of FIG. 4 in accordance with the invention removed from the commercial setting.
Figure 6:
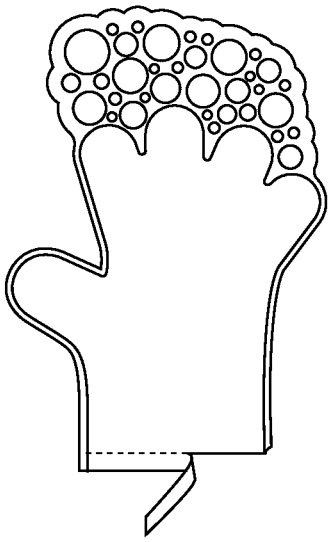
FIG. 6 is a front elevation view of the embodiment of an article for generating bubbles of FIG. 4 in accordance with the invention with the proximal tearoff strip being removed.

FIGS. 4-7 depict a slightly modified bubble glove 108, in which the glove portion includes a tearoff strip 112 that is removably attached to the proximal end of the glove via a scored or perforated (or the like) region 115. That is, glove 108 is made and purchased entirely sealed, and prior to use, the user rips off tearoff strip 112, as shown in FIGS. 5 and 6.

Figure 7:
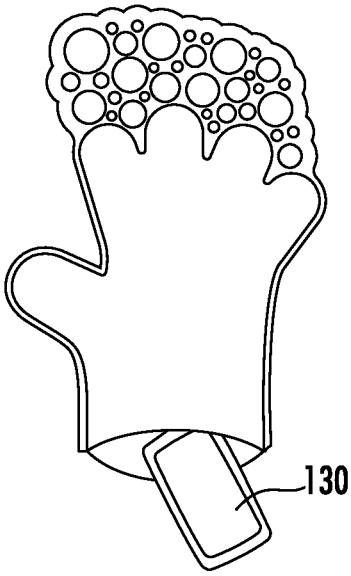
FIG. 7 is a front perspective view of the embodiment of an article for generating bubbles of FIG. 4 in accordance with the invention with the proximal tearoff strip removed and an item emerging therefrom.

In FIG. 7, item 130 is shown emerging from the interior of glove 108. Item 130 can be a packet of soapy material (e.g., either liquid, gel, powder, or the like) to be added to water to form the bubble solution required to make bubbles as described below. In addition or in the alternative, item 130 can be a bar of soap for a child (or adult) to use in the bath. The interior of glove 108 could also contain loose soapy material not in packet form. It is envisioned that loose soapy material would preferably be in powder form, since one of the advantages of the invention is not to get sticky soap on one's hands, and providing liquid or gel soapy material inside the glove one will be placing one's hand tends to defeat that advantage. Any other reasonably sized items can also be placed inside the glove, e.g., small toys, pens, assorted collectibles or tchotchkes, and the like.

As shown in FIG. 4, a number of bubble gloves 108 are being displayed in a commercial setting, i.e., being hung on peg P of a pegboard (not shown). In this way, bubble glove 108 is not only the article being used to make bubbles, but it also serves as its own packaging, not requiring any additional outer wrapping or the like. As shown in FIG. 4, peg P is passed through one of the holes 24 of bubble glove 108.

Figure 3:
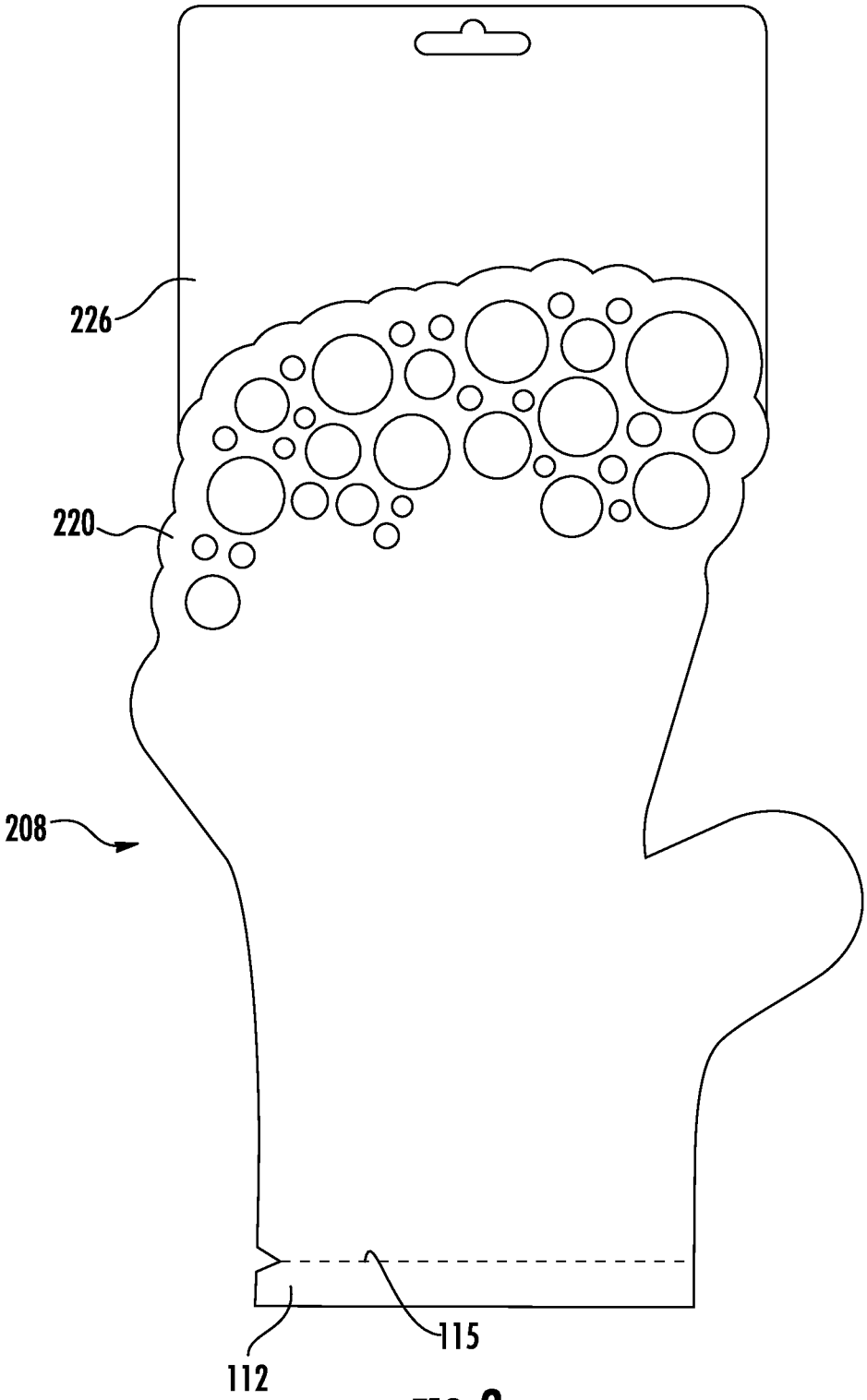
FIG. 3 is a front elevational view of an article for generating bubbles having a removable header card and tearoff strip in accordance with the invention.

A slightly modified bubble glove 208 is shown in FIG. 3. Glove 208 is similar to glove 108 but also includes a distal header card 226 for hanging in a commercial setting.

Figure 8A:
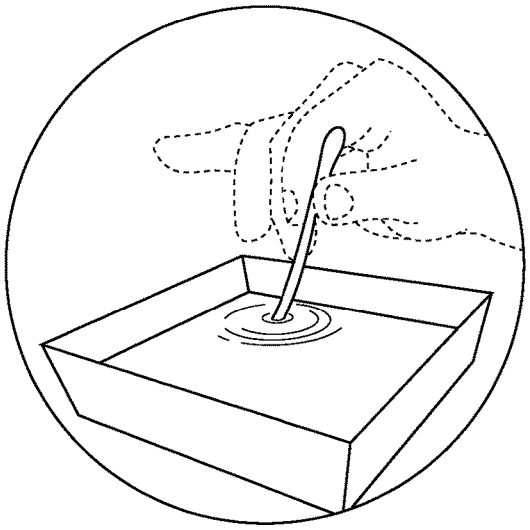
FIGS. 8A, 8B, and 8C are schematic illustrations of the operation of an article for generating bubbles in accordance with the invention.
Figure 8B:
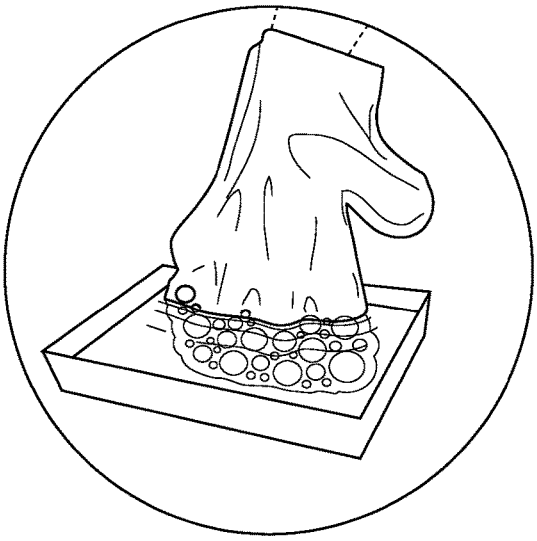
Figure 8C:
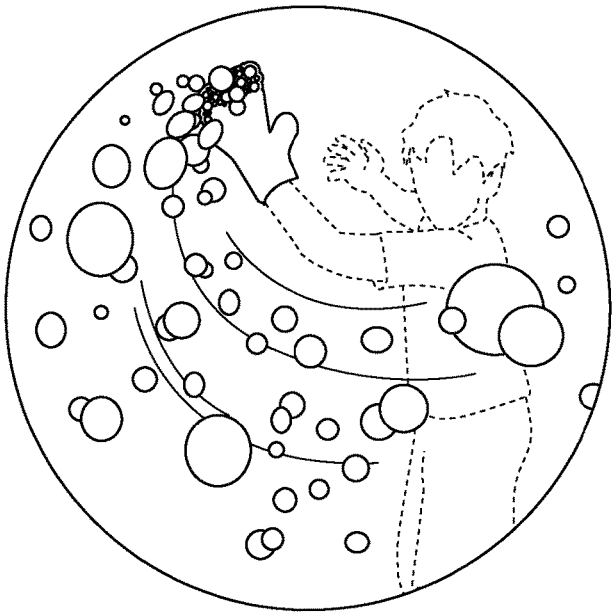

FIGS. 8A-C depict the use of the bubble glove. In operation, in FIG. 8A, the user first mixes the soap concentrate with water in step 1 to form a bubble solution known conventionally. Next, in step 2, the user puts the glove 8, 108, 208 on his/her hand and dips the distal web 22 into the solution, as shown in FIG. 8B. Finally, in step 3, the user waves his/her arm around to generate bubbles as shown in FIG. 8C. Alternatively, the user could blow on the distal web 22 in the manner of using a conventional bubble wand.

Figure 10:
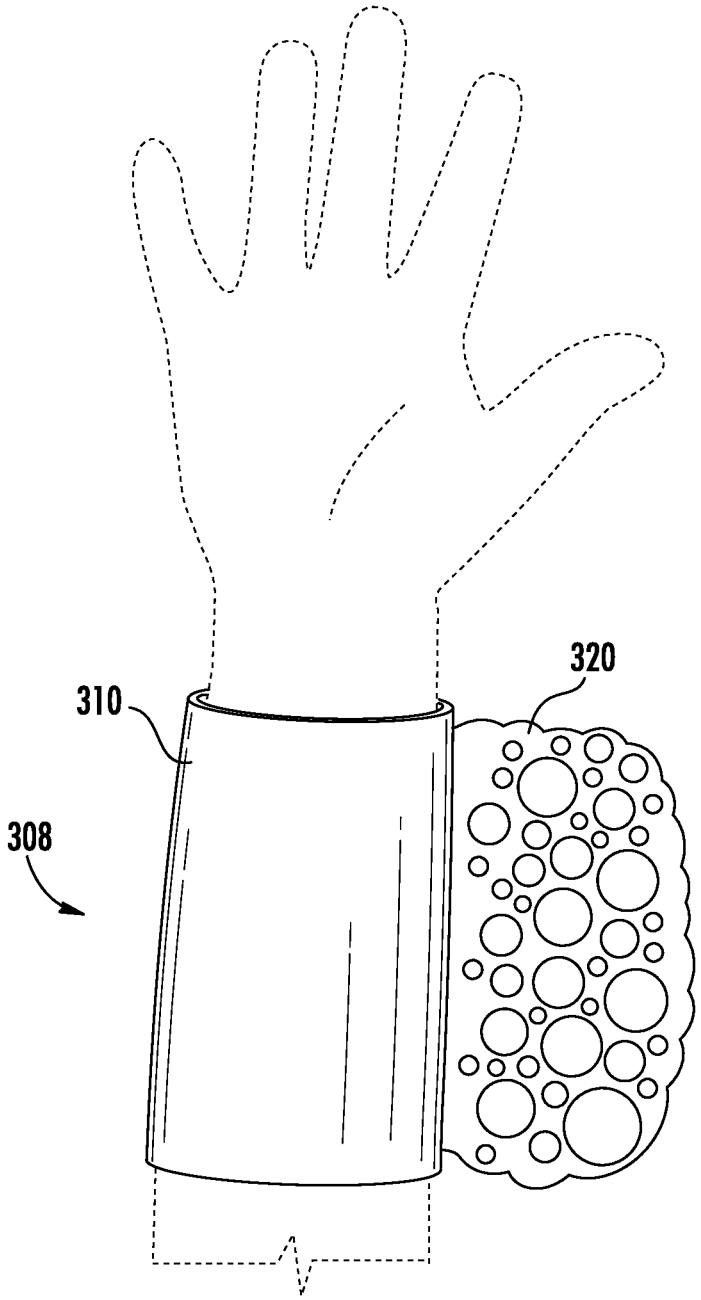
FIG. 10 is a schematic illustration of a modification of the article for generating bubbles in accordance with the invention.

The invention is not limited to the above description. For example, other shapes are contemplated. FIG. 10 depicts a modification to the bubble glove—the bubble sleeve or gauntlet 308. Here, the device is tubular/cylindrical and is secured to a person's arm via sleeve 310. Alternatively, it could be secured to a person's ankle or leg in the same manner. Instead of a distal web, sleeve 308 has a lateral web 320 with holes as above. It is used in the same manner as above.

Figure 9:
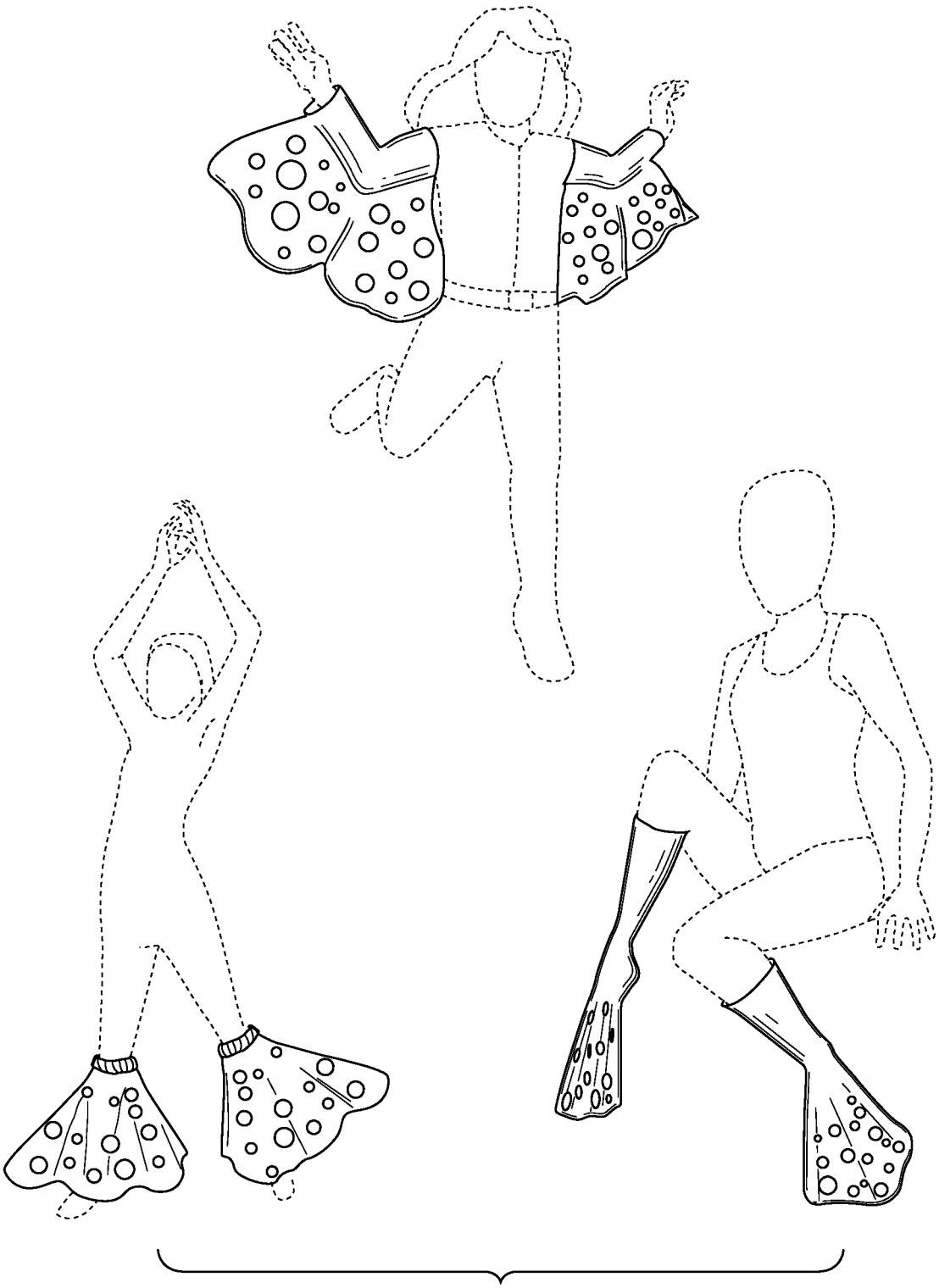
FIG. 9 is a series of schematic illustrations of other shapes of articles for generating bubbles in accordance with the invention.

FIG. 9 depicts other wearable bubble generating items, such as a flippers, wings, or leggings.

Preferably, the invention is made from one or more forms of plastic films. In one embodiment, each film is made from one layer of polyethylene terephthalate such as Mylar® sold by DuPont, and another layer made from copolymer polypropylene. In one embodiment, the outer layer has artwork printed on its inner surface. The outer layer (e.g., a Mylar® layer) is laminated to the inner layer via, for example, heat welding. The two films are then heat welded together in the glove or other desired shape. The welded together films are then die cut to form the hole pattern in the web. Preferred thicknesses of the films depend on the materials being used; in the Mylar®/copolymer polypropylene embodiment, preferred thicknesses are approximately 0.003-0.010 inches thick. Other suitable films can be made from polyethylene, for example, among other plastic films capable of some rigidity to avoid bending too much when waved around.

Having described certain embodiments of the invention, it should be understood that the invention is not limited to the above description or the attached exemplary drawings. Rather, the scope of the invention is defined by the claims appearing hereinbelow and includes any equivalents thereof as would be appreciated by one of ordinary skill in the art.

What is claimed is:

1. An article for soap bubble generation, comprising:

an article having at least two flexible and planar films of liquid-resistant material sealed on at least one common edge and forming a liquid resistant pocket between said films; and a distal planar web provided integrally with said article and extending distally from said sealed common edge, said distal web having at least one hole adapted to form soap bubbles when said web is dipped in bubble solution and air is moved through said at least one hole, wherein respective distal ends of said at least two films are fused together as said distal planar web, and wherein substantially all of said distal web is more rigid than individual of said at least two films.

2. An article for soap bubble generation according to claim 1, wherein said article is a glove or mitten and said pocket is shaped to receive a hand.

3. An article for soap bubble generation according to claim 1, wherein said article is sock-like and said pocket is shaped to receive a foot.

4. An article for soap bubble generation according to claim 1, a proximal end of said article further comprising a removable edge portion sealing said pocket closed and being manually removable.

5. An article for soap bubble generation according to claim 4, said removable edge portion being attached to said article via a manually tearable region.

6. An article for soap bubble generation according to claim 5, wherein said manually tearable region is scored or perforated.

7. An article for soap bubble generation according to claim 1, wherein said at least one hole in said distal web further comprises a plurality of holes.

8. An article for soap bubble generation according to claim 7, wherein said plurality of holes in said distal web are formed in a plurality of different sizes.

9. An article for soap bubble generation according to claim 4, further comprising a secondary article provided inside said pocket, wherein said article functions as packaging for said secondary article.

10. An article for soap bubble generation according to claim 9, wherein said secondary article comprises at least one of a container of bubble solution or a packet of soap powder to be made into bubble solution.

11. An article for soap bubble generation according to claim 9, wherein said secondary article comprises at least one of a toy or collectible.

12. An article for soap bubble generation according to claim 1, wherein said at least two films are comprised of plastic and are heat welded together at said at least one common edge.

13. An article for soap bubble generation according to claim 1, wherein each of said films comprises at least one layer of polyethylene terephthalate and at least one layer of copolymer polypropylene.

14. An article for soap bubble generation according to claim 1, wherein each of said films comprises at least one layer of polyethylene.

15. An article for soap bubble generation, comprising:

an article having at least one flexible and planar film of liquid-resistant material and a liquid resistant pocket formed in said film; and a distal planar web provided integrally with and extending distally from said article, said web having at least one hole adapted to form soap bubbles when said web is dipped in bubble solution and air is moved through said at least one hole, wherein at least two portions of said at least one film are fused together as said distal planar web, and wherein substantially all of said distal web is more rigid than individual of said at least two portions of at least one film.

16. An article for soap bubble generation according to claim 15, wherein said article is substantially tubular and said pocket is shaped to be placeable on a limb.

17. An article for soap bubble generation according to claim 15, wherein said at least one hole in said distal web further comprises a plurality of holes.

18. An article for soap bubble generation according to claim 17, wherein said plurality of holes in said distal web are formed in a plurality of different sizes.

19. An article for soap bubble generation according to claim 15, wherein said article comprises at least one layer of polyethylene terephthalate and at least one layer of copolymer polypropylene.

20. An article for soap bubble generation according to claim 15, wherein said article comprises at least one layer of polyethylene.

* * * * *